US008070016B2

(12) United States Patent
Kawakami et al.

(10) Patent No.: US 8,070,016 B2
(45) Date of Patent: Dec. 6, 2011

(54) POUCH FOR REFILL OF CONTENTS

(75) Inventors: Soichi Kawakami, Yokohama (JP); Kazumi Ozawa, Yokohama (JP); Koichi Ishizaka, Yokohama (JP); Takayuki Aikawa, Yokohama (JP)

(73) Assignee: Toyo Seikan Kaisha, Ltd., Tokyo (JP)

( * ) Notice: Subject to any disclaimer, the term of this patent is extended or adjusted under 35 U.S.C. 154(b) by 840 days.

(21) Appl. No.: 11/922,400

(22) PCT Filed: Jun. 19, 2006

(86) PCT No.: PCT/JP2006/312219

§ 371 (c)(1),
(2), (4) Date: Dec. 18, 2007

(87) PCT Pub. No.: WO2007/010693

PCT Pub. Date: Jan. 25, 2007

(65) Prior Publication Data

US 2009/0134185 A1 May 28, 2009

(30) Foreign Application Priority Data

Jul. 20, 2005 (JP) ..... 2005-210634

(51) Int. Cl.
*B65D 5/72* (2006.01)

(52) U.S. Cl. ..... 222/107; 383/33; 383/906; 222/541.9; 222/564

(58) Field of Classification Search ..... 383/122, 383/33, 44, 906; 222/92–107, 386.5, 541.1, 222/541.6, 541.9, 564, 566, 574, 572
See application file for complete search history.

(56) References Cited

U.S. PATENT DOCUMENTS

| | | | | | |
|---|---|---|---|---|---|
| 3,184,121 | A * | 5/1965 | Volckening | 222/213 |
| 4,498,591 | A * | 2/1985 | Smith, II | 383/209 |
| 4,717,046 | A * | 1/1988 | Brogli | 222/107 |
| 4,732,299 | A * | 3/1988 | Hoyt | 222/94 |
| 6,209,754 | B1 * | 4/2001 | Suzumi | 222/92 |
| 6,435,374 | B1 * | 8/2002 | Tabaroni | 222/107 |
| 6,667,081 | B1 * | 12/2003 | Aoki et al. | 428/34.1 |
| 2005/0067046 | A1 * | 3/2005 | Furukawa et al. | 141/18 |

FOREIGN PATENT DOCUMENTS

| | | | |
|---|---|---|---|
| JP | H11-11498 | A | 1/1999 |
| JP | H11-59704 | A | 3/1999 |
| JP | H11-314652 | | 11/1999 |
| JP | 2001-48197 | | 2/2001 |
| JP | 2001048197 | A * | 2/2001 |
| JP | 2001-213448 | | 8/2001 |
| JP | 2006-232281 | A | 9/2006 |

* cited by examiner

*Primary Examiner* — Kevin P Shaver
*Assistant Examiner* — Andrew Bainbridge
(74) *Attorney, Agent, or Firm* — Manabu Kanesaka

(57) ABSTRACT

A pouch is formed out of two sheets of plastic heat sealed over most of the edge length. The pouch has an expanding bottom feature and has a pouring spout formed by raised impressions in the corresponding sheets of plastic that form matching embossments. When the pouch is squeezed, the embossments open further apart to form a larger fluid passage at the outlet. The outlet of the pouch is opposite the bottom of the pouch and in at least one embodiment has a region on both sides of the outlet that are kept free from heat sealing during manufacture. The outlet also has a frangible line of weakness for easy opening. The outlet passage has two sets of embossments that meet along a center line to more fully expand the central portion of the pouch.

7 Claims, 6 Drawing Sheets

(a)

(b)

POUCH FOR REFILL OF CONTENTS

BACKGROUND OF THE INVENTION

1. Field of the Invention

The present invention relates to a pouch for refill of contents, used as a container for refill such as detergent, bleach, softening agent, laundry starch, shampoo, conditioner, or the like, and having a nozzle for discharging the contents at the time of transferring the contents to another container for use.

2. Description of the Related Art

In recent years, as awareness of recycling increases, a pouch for refill of contents provided with a nozzle for discharging the contents is used more and more as a refill container whose contents are transferred to another container for use such as a plastic bottle or a glass bottle.

In a pouch for refill of contents of this kind, generally, a discharge port is formed in the nozzle by tearing off a tip part of the nozzle to open the pouch. It is desired that the contents can be discharged while maintaining stable flow till the end without closing the discharge port at the time of transferring the contents to another container.

Consequently, for example, Japanese Patent Application Laid-open No. 2001-213448 discloses a configuration in which a curved swollen part is formed by embossing from a discharge port to a position near to a corner at the bottom. In Japanese Patent Application Laid-open No. 2001-213448, with such a configuration, a discharge port having good shape retention is open, so that the contents can be easily transferred without closing the discharge port in process of discharging.

The curved swollen part formed in Japanese Patent Application Laid-open No. 2001-213448 is formed by performing three-dimensional process (embossing) on a resin film used as the base material of a pouch for refill of contents. However, after the contents are transferred, the pouch of this kind is generally discarded as it is, so that the cost is severely controlled. When the large-scaled three-dimensional process is performed on the base material film, disadvantages arise such that it requires labor for the process and the process cost increases.

Manufactured pouches for refill of contents are usually packed and carried to contents filling process. However, since the parts to which three-dimensional process has been performed are bulky at the time of packing and the number of pouches which can be packed is limited, the pouches are disadvantageous in the view of cost of carry. There is also a disadvantage such that when the parts each having the three-dimensional shape are pressed in a state where there are packed in a box, the function of the three-dimensional parts cannot be fully displayed.

Further, the three-dimensional process may cause a crack in the base material film. The more the three-dimensional shape is complicated or the larger the area in which the three-dimensional process is performed, the more various problems as described above occur conspicuously.

Consequently, it is requested to enable the contents to be stably discharged while preventing a discharge port from being closed with a simpler structure at the time of transferring the contents to another container.

The inventors of the present invention eagerly conducted studies by paying attention to the point that when a pouch for refill of contents of this kind is filled with the contents, a ridge line is formed from a center part of the bottom toward a corner on the top side in the surface of a base material film of the pouch. The inventors herein have found that by guiding the ridge line along the center line of the nozzle, the contents can be discharged while maintaining stable flow till the end without closing a discharge port formed in the nozzle after opening, and have achieved the present invention.

SUMMARY OF THE INVENTION

In short, the present invention has been proposed to solve the problems of the conventional techniques as described above, and an object of the invention is to provide a refill pouch whose contents can be easily transferred to another container such as a plastic bottle or a glass bottle by preventing a discharge port from being closed with a simpler structure at the time of discharging the contents.

To solve the problems, according to the present invention, there is provided a pouch for refill of contents obtained by forming a bag by using a base material film made of a flexible package material so as to include a nozzle for discharging the contents, wherein a ridge line guiding part is provided in a base part of the nozzle so that a ridge line formed in the surface of the base material film when the base material film is pressed from the inside by the contents filled is guided in a direction along a center line of the nozzle.

The pouch for refill of contents according to the present invention employing such a configuration has been achieved based on a novel idea, which has not been conventionally achieved, of guiding a ridge line formed in the surface of a pouch for refill of contents which is filled with contents, along the center line of the nozzle. With the very simple structure of guiding a ridge line formed in the surface of the film base material along the center line of the nozzle, closing of the discharge port at the time of discharging the contents can be effectively prevented.

Any ridge line guiding part for guiding the ridge line is employed as long as it can suppress deformation of the base material film that crosses the ridge line guiding part and change the ridge line formation direction. Even if pouches are pressed in a state where they are packed in a box, the function hardly deteriorates.

The pouch for refill of contents according to the invention can have a configuration such that the ridge line guiding part comprise a horizontal part and a trailing part which are in contact with each other on the center line of the nozzle, the horizontal part and the trailing part being formed by a three-dimensional process performed on the base material film.

With such a configuration, the base material film forming the nozzle is bent along the center line of the nozzle, thereby increasing the open area of the discharge port formed in the nozzle after opening. Further, by obtaining good balance between the length in the vertical direction and the length in the horizontal direction of the discharge port, the nozzle can be inserted more easily to an inlet port of another container to which the contents is transferred.

The pouch for refill of contents according to the invention can also have a configuration that the ridge line guiding part has an extended part which extends from a contact point between the horizontal part and the trailing part toward the tip side of the nozzle along the center line of the nozzle.

With the configuration, the base material film forming the nozzle can be bent along the center line more easily.

The pouch for refill of contents according to the invention can also have a configuration in which an adhesion preventing part for preventing adhesion between facing surfaces of the base material film in the nozzle is formed around the extended part.

With the configuration, adhesion between the base material films forming the nozzle is prevented so that closing of the discharge port formed in the nozzle after opening can be avoided more effectively. In addition, the discharge port opens in a shape closer to a circular shape, so that the open area of the discharge port can be increased. Further, insertion of the nozzle to an inlet port of another container to which the contents is transferred is more facilitated.

According to the present invention as described above, with a very simple structure of guiding a ridge line formed in the surface of a film base material along the center line of a nozzle, closing of a discharge port formed by opening in the nozzle at the time of discharging the contents is effectively avoided, and a work of transferring the contents to another container can be performed easily.

DESCRIPTION OF THE PREFERRED EMBODIMENTS

A preferred embodiment of a pouch for refill of contents according to the present invention will be described hereinbelow with reference to the drawings.

Figure 1:
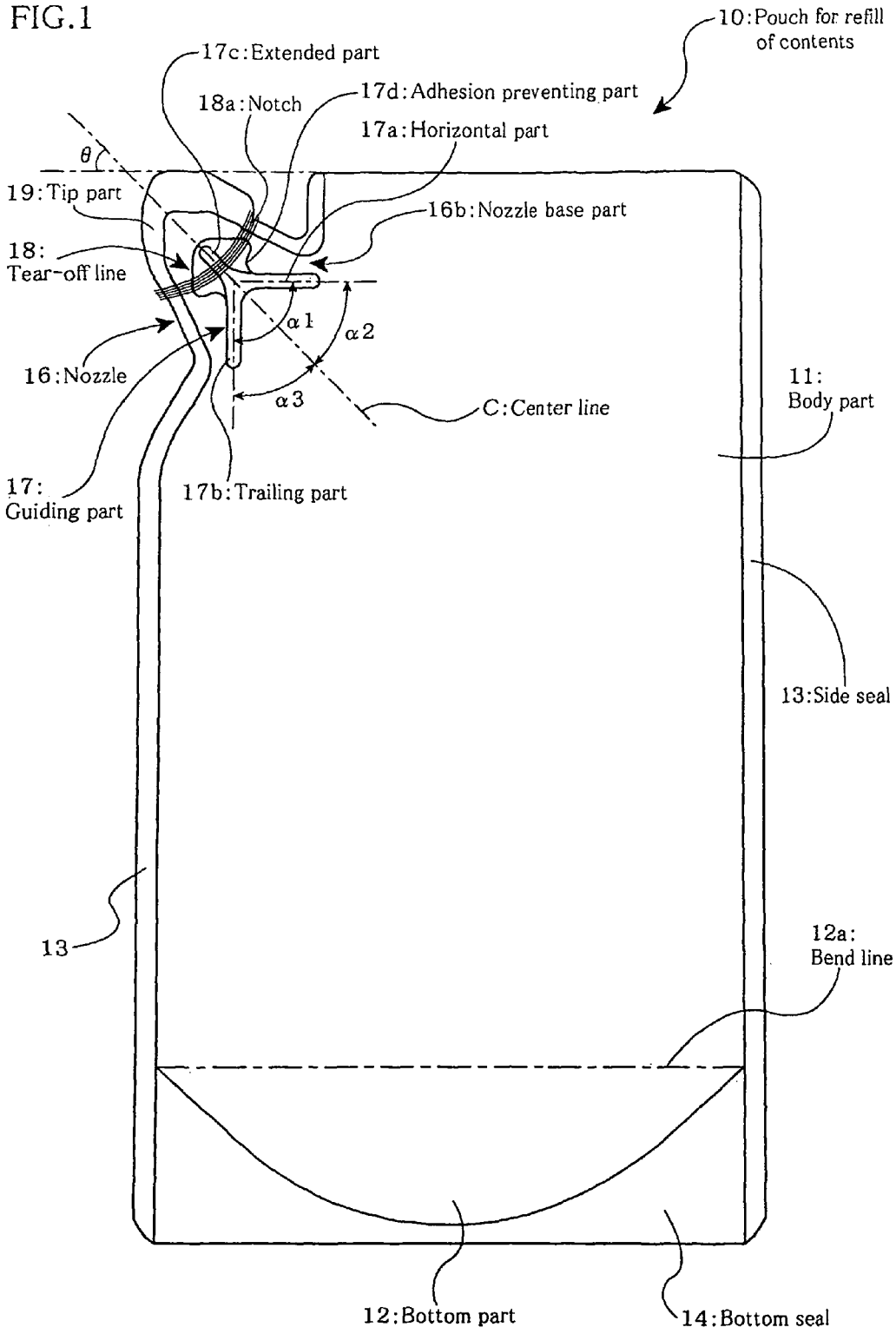
FIG. 1 is a plan view schematically showing an embodiment of a pouch for refill of contents according to the present invention.

FIG. 1 is a schematic plan view showing an embodiment of a pouch for refill of contents according to the invention.

A pouch for refill of contents 10 shown in FIG. 1 can be manufactured by forming a bag by using a base material film made of a flexible package material such as a resin film so that a nozzle 16 for discharging the contents is formed so as to project obliquely upward at the left upper corner of a body part 11 in the drawing.

Generally, the pouch for refill of contents 10 of this kind is manufactured by a flow process of a heat sealing process and a cutting process, and the like, including the steps of folding a bottom member forming a bottom part 12 along a bend line 12*a* so as to be sandwiched between a surface member and a back face member forming the body part 11, making a bottom seal 14 between the body part 11 and the bottom part 12 while sequentially feeding a long material sheet, making a side seal 13 on side edges of the body part 11, and then cutting away unnecessary parts along the outline. The pouch for refill of contents 10 in the embodiment can be also manufactured in a manner similar to the above.

In the example shown in FIG. 1, the nozzle 16 is formed inclined so that an angle θ formed between a center line C and the top of the pouch for refill of contents 10 becomes about 45 degrees. The tilt angle of the nozzle 16 and concrete parts to be formed of the nozzle 16 can be properly set in consideration of ease of carry at the time of refilling work, dischargeability of the contents, and the like. An example of a preferable angle θ formed between the center line C of the nozzle 16 and the top of the pouch for refill of contents 10 is 20° to 70°.

Figure 3:
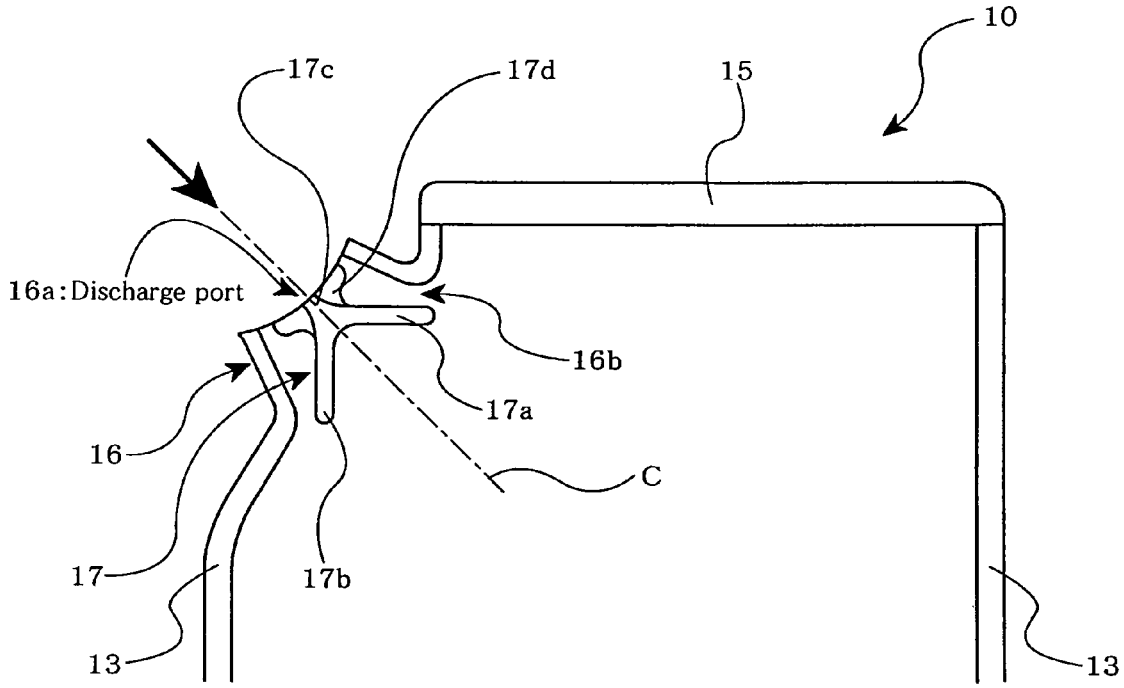
FIG. 3 is a diagram illustrating a state where a discharge port is formed by tearing off a tip part of a nozzle.

In the nozzle 16, as shown in the diagram, a tear-off line 18 crossing the nozzle 16 can be also formed. Further, a notch 18*a* can be formed at the tear-off start position in the tear-off line 18. The tear-off line 18 is formed to open the pouch by tearing off a tip part 19 of the nozzle 16. In the nozzle 16 after the tip part 19 is torn off along the tear-off line 18, as shown in FIG. 3, a discharge port 16*a* as a pourer to transfer the contents to another container is formed.

In the example shown in FIG. 1, the top part of the pouch for refill of contents 10 is unsealed. The pouch for refill of contents for refill of contents 10 is usually carried in a state where the top part is unsealed to contents filling step. After the pouch 10 is filled with the contents, a top seal 15 is made. In the pouch 10 which is filled with the contents, the bottom part 12 which was folded along the bend line 12*a* is unfolded, so that the shape of the pouch for refill of contents 10 becomes conical or pyramid and the pouch 10 can stand alone.

At this time, the contents filled in the pouch for refill of contents 10 pushes the base material film forming the side faces of the body part 11 from the inside, so that the energizing force from the side edges to the center of the pouch for refill of contents 10 is generated so as to pull the side edges of the pouch for refill of contents 10 to the center. With the energizing force, the base material film forming the side faces of the body part 12 is deformed, and it makes a ridge line 20 that extends from the center of the bottom part 12 toward the corner on the top side.

Figure 2A:
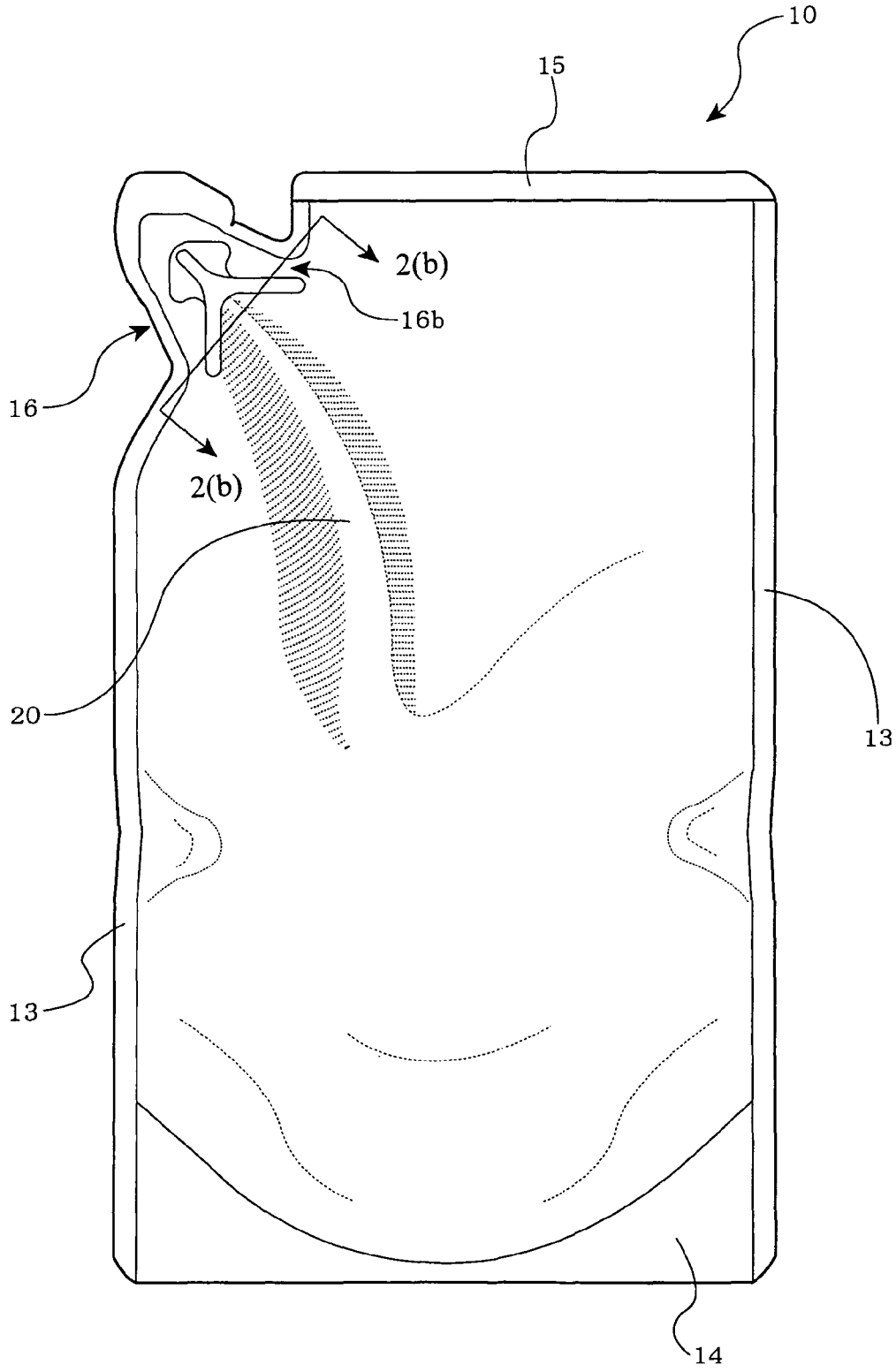
FIG. 2(*a*) is a diagram illustrating a state where the pouch for refill of contents as an embodiment of the present invention is filled with contents, and FIG. 2(*b*) is a sectional view taken along line 2(*b*)-2(*b*) in FIG. 2(*a*).
Figure 2B:
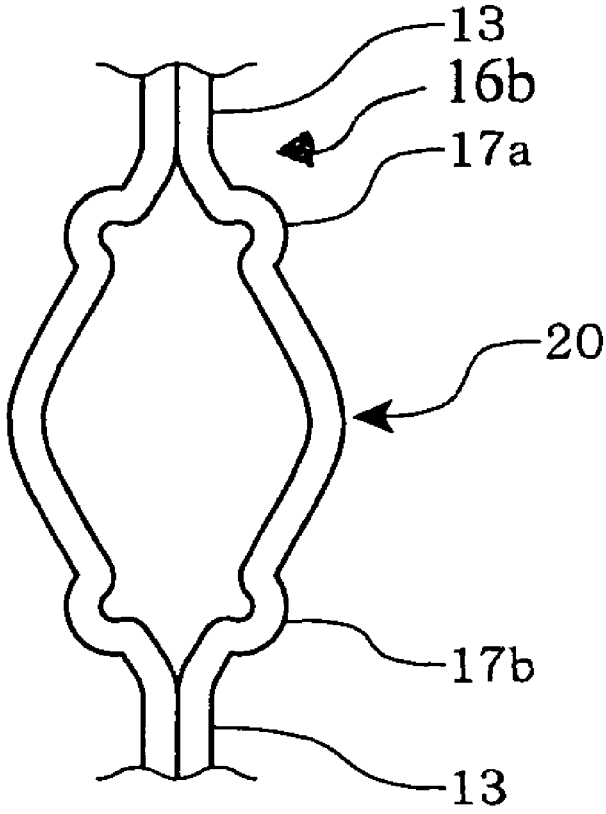

In the pouch for refill of contents 10 in the embodiment, as shown in FIG. 2, when the contents is filled and the ridge line 20 is formed in the surface of the base material film as described above, the ridge line 20 is guided along the center line C of the nozzle 16.

FIG. 2 shows a representative example in which the ridge lines 20 is formed in the surface of the base material film at the time of filling the pouch 10 with the contents. The position in which the ridge line 20 is actually formed on the bottom part 12 side of the pouch for refill of contents 10 varies according to the shape of the pouch for refill of contents 10, the volume of the contents, and the like.

When the ridge line 20 formed in the surface of the base material film is guided along the center line C of the nozzle 16, the base material film forming the nozzle 16 is pulled outward along the center line C. Consequently, when the pouch 10 is opened by tearing off the tip part 19 of the nozzle 16, the energizing force for making the discharge port 16*a* formed in the nozzle 16 always open acts on the base material film forming the nozzle 16. As a result, at the time of discharging the contents from the discharge port 16*a* formed in the nozzle 16, the contents can be discharged while maintaining the stable flow till the end without closing the discharge port 16*a*.

In the embodiment, to guide the ridge line 20 formed in the surface of the base material film along the center line C in the nozzle 16, it is sufficient to form a ridge line guiding part 17 in a base part 16*b* of the nozzle 16. It is sufficient for the ridge line guiding part 17 to suppress deformation of the base material film crossing the ridge line guiding part 17 and change the direction of forming the ridge line 20 so that the ridge line 20 formed in the surface of the base material film is not formed over the ridge line guiding part 17. The ridge line guiding part 17 may be formed by performing a three-dimensional process (embossing or the like) of, for example, making the base material film partially swollen, marking a crease, or the like.

In the example shown in the diagram, the ridge line guiding part 17 is constructed by a horizontal part 17*a* and a trailing part 17*b* formed by making the base material film partially swollen. The ridge line 20 is guided toward the contact point between the horizontal part 17*a* and the trailing part 17*b*.

To guide the ridge line 20 by the ridge line guiding part 17, preferably, the horizontal part 17*a* is formed so as to be almost parallel with the top part of the pouch for refill of contents 10, and the trailing part 17*b* is formed so as to be almost parallel with the side edges of the pouch for refill of contents 10. Therefore, an intersection angle $\alpha 1$ between the horizontal part 17*a* and the trailing part 17*b* is preferably about 90°. The intersection angle $\alpha 1$ between the horizontal part 17*a* and the trailing part 17*b* can be also properly adjusted within the range of 60° to 120° by tilting either of the horizontal part 17*a* or the trailing part 17*b*, or both of them, in accordance with the tilt angle $\theta$ of the nozzle 16, and the like.

Figure 5:
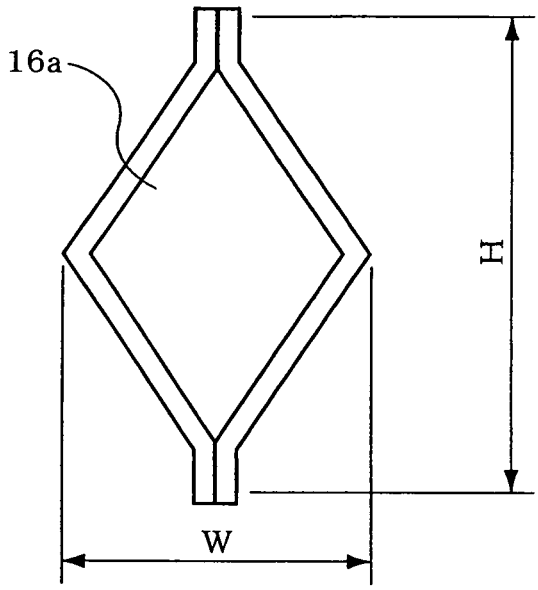
FIGS. 5(*a*) and 5(*b*) are diagrams illustrating the opening shapes of the discharge port.
Figure 5:
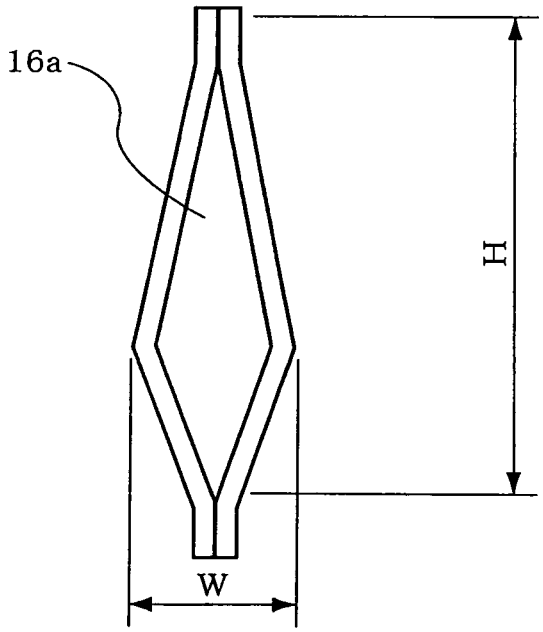

The discharge port 16*a* formed in the nozzle 16 is usually opened by bending the base material film forming the nozzle 16. When the ridge line 20 is guided along the center line C in the nozzle 16 in this occasion, the base material film forming the nozzle 16 bends easily along the center line C. And, as shown in FIG. 5(*a*), the discharge port 16*a* opens in a rhombic shape (preferably, square shape), and the open area can be increased. Further, when the discharge port 16*a* opens in the rhombic shape, length in the vertical direction H of the discharge port 16*a* and length in the horizontal direction W are balanced. Consequently, the nozzle 16 can be easily inserted to an inlet port of another container to which the contents is transferred.

On the other hand, as shown in FIG. 5(*b*), when the position in which the base material film bends is deviated from the center line C in the nozzle 16, the discharge port 16*a* does not open in a rhombic shape. And, as compared with the case where the discharge port 16*a* opens in the rhombic shape, the discharge port 16*a* is suppressed to open in the horizontal direction, the open area of the discharge port 16*a* is reduced, and also the length in the vertical direction H of the discharge port 16*a* increases. Therefore, it becomes difficult to insert the nozzle 16 into the inlet port of another container.

As described above, the ridge line 20 is guided toward the contact point between the horizontal part 17*a* and the trailing part 17*b*. To make the discharge port 16*a* easily open in the rhombic shape by guiding the ridge line 20 along the center line C of the nozzle 16 and bending the base material film forming the nozzle 16 along the center line C, it is preferable to position the contact point between the horizontal part 17*a* and the trailing part 17*b* on the center line C of the nozzle 16.

Preferably, the ridge line guiding part 17 is formed symmetrically with respect to the center line C of the nozzle 16 as an axis of symmetry. It facilitates guiding of the ridge line 20 to the center line C of the nozzle 16. Each of an angle $\alpha 2$ of the horizontal part 17*a* with respect to the center line C of the nozzle 16 and an angle $\alpha 3$ of the trailing part 17*b* with respect to the center line C of the nozzle 16 can be properly adjusted within the range of 20° to 100° in accordance with the tilt angle $\theta$ of the nozzle 16 and the like.

In the illustrated example, an extended part 17*c* is formed which extends from the contact point between the horizontal part 17*a* and the trailing part 17*b* toward the tip side of the nozzle 16 along the center line C of the nozzle 16. By the extended part 17*c*, the base material film forming the nozzle 16 is bent along the center line C more easily.

Figure 4:
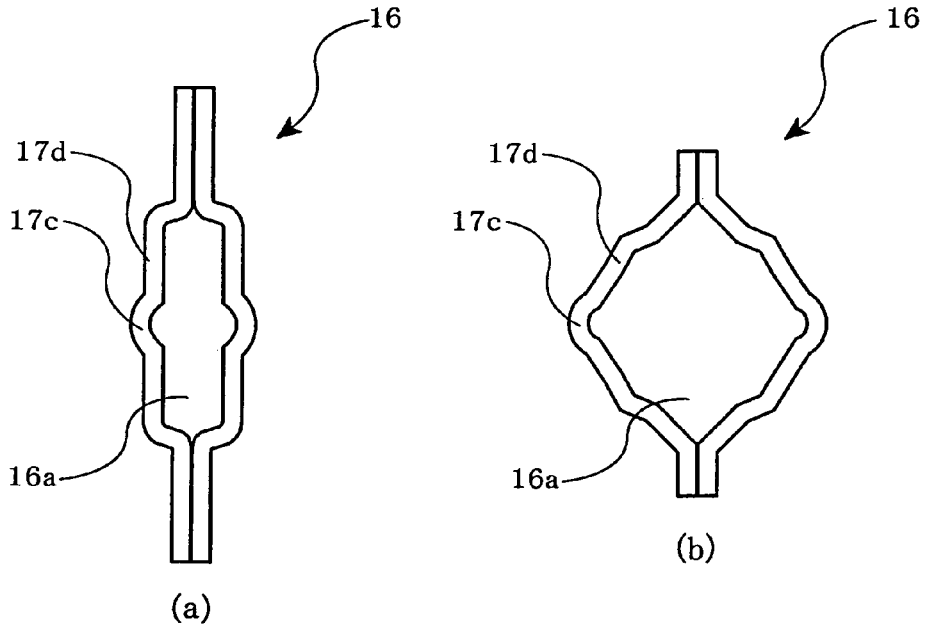
FIGS. 4(*a*) and 4(B) are diagrams illustrating the discharge port viewed from the direction of the arrow in FIG. 3, wherein FIG. 4(*a*) shows a state before the discharge port opens and FIG. 4(*b*) shows a state where the discharge port opens.

In the illustrated example, an adhesion preventing part 17*d* crossing the tear-off line 18 is formed in an almost triangle shape around the extended part 17*c*. The adhesion preventing part 17*d* is formed by making the base material films swell, as shown FIG. 4(*a*), so as to prevent adhesion of the base material films forming the nozzle 16, and to avoid closing of the discharge port 16*a* formed in the nozzle 16 after opening opened and, in addition, to make the discharge port 16*a* open in a shape more closely to a circle as shown in FIG. 4(*b*). By making the opening shape of the discharge port 16*a* closer to a circle shape, the open area of the discharge port 16*a* can be formed largely, and it facilitates insertion of the nozzle 16 into the inlet port of another refillable container.

FIGS. 4(*a*) and 4(*b*) are diagrams illustrating the discharge port 16*a* viewed from the direction of the arrow in FIG. 3. FIG. 4(*a*) shows a state before the discharge port 16*a* opens. FIG. 4(*b*) shows a state where the discharge port 16*a* opens.

As described above, according to the embodiment, with a very simple structure of guiding the ridge line 20 formed in the surface of the film material along the center line C in the nozzle 16, closing of the discharge port 16*a* at the time of discharging the contents can be effectively avoided.

It is sufficient that the ridge line guiding part 17 for guiding the ridge line 20 can suppress deformation of the base material film crossing the ridge line guiding part 17 and change the formation direction of the ridge line 20. Therefore, even if the pouch is pressed in a packed state, the function hardly deteriorates.

In the pouch for refill of contents 10 in the embodiment, the material of the base material film (flexible package material) to be used is not limited. Examples of resin materials suitable for forming the base material film include thermoplastic resins such as: polyolefins such as crystalline polypropylene, crystalline propylene-ethylene copolymer, crystalline polybutene-1, crystalline poly 4-methylpentene-1, low-density, intermediate-density, or high-density polyethylene, ethylene-vinyl acetate copolymer (EVA), ethylene ethyl acrylate copolymer (EEA), and ion crosslinking olefin copolymer (ionomer); aromatic vinyl copolymers such as polystyrene and styrene-butadiene copolymer; vinyl halide polymers such as polyvinyl chloride and vinylidene chloride resin; nitrile polymers such as acrylonitrile-styrene copolymer, acrylonitrile-butadiene-styrene copolymer; polyamides such as nylon 6, nylon 66, and para- or meta-xylene adipamide; polyesters such as polyethylene terephthalate and polytetramethylene terephthalate; various polycarbonates; and polyacetals such as polyoxymethylenes. A flexible package material made of any of the materials can be used by being subjected to non-stretching, monoaxial stretching, or biaxial stretching.

The base material film used for the pouch for refill of contents 10 can be constructed by a single layer or by stacking two or more layers. The one or plural layers of the base material film can be constructed by being bonded with metal foil of aluminum or the like, a deposited film made of metal or metal oxide, paper, cellophane, or the like. Examples of a preferred base material film are, for example, a two-layer film of a stretched nylon film as an outer layer and a polyolefin film made of low-density polyethylene, polypropylene, or the like as an inner layer; a two-layer film of a stretched polyester film as an outer layer and the polyolefin film as an inner layer, a three-layer film in which metal foil of aluminum or the like is mounted between outer layer film and inner layer film. At the time of manufacturing the laminated films, an adhesive and an anchor agent can be interposed between layers as necessary.

The layer configuration of the base material film is selected according to the property of the contents filled in the pouch for refill of contents 10. For example, in the case where low cost is requested like a detergent refill pouch, a laminated film having the two-layers configuration is used. In the case where storability is required like a seasoning refill pouch, a laminated film constructed by three or more films including aluminum foil is used.

In the pouch for refill of contents 10 of the embodiment, the tear-off line 18 formed in the nozzle 16 can be formed by, for example, grooving the surface of the base material film with a laser marker of the optical reflection type. The laser marker of the optical reflection type can move the focal point of a laser by operating the optical axis (angle) of a mirror, and easily form a more complicated figure or pattern by operating the optical axis (angle) of the mirror. It is preferable to use, as a laser, a carbon dioxide gas laser enabling selective processing according to the kind of a resin film.

Preferably, the tear-off line 18 is formed as a collection of a plurality of (five in the illustrated example) grooves arranged in parallel rather than a single continuous groove or a single broken-line groove. With the collection of grooves, ease of opening of the nozzle 16 and stability of the opening direction at the time of opening improves. The user can easily tear off the tip part 19 of the nozzle 16 with his/her fingers so that the discharge port 16*a* having a predetermined shape can be formed easily.

To such a tear-off line 18, easy-opening process proposed in Japanese Patent Application Laid-Open No. 2003-94532 by the applicant of the present invention can be applied.

Although the present invention has been described above by the preferred embodiment, obviously, the invention is not limited only to the foregoing embodiment but can be variously modified.

Although the example in which the nozzle 16 is formed so as to be projected linearly has been described in the foregoing embodiment, the shape and dimensions of the nozzle 16 can be properly set according to the property of the contents to be filled, the dimensions of the pouch for refill of contents 10, and the like. As necessary, a shape in which one or both side edges is/are curved can be used.

Figure 6:
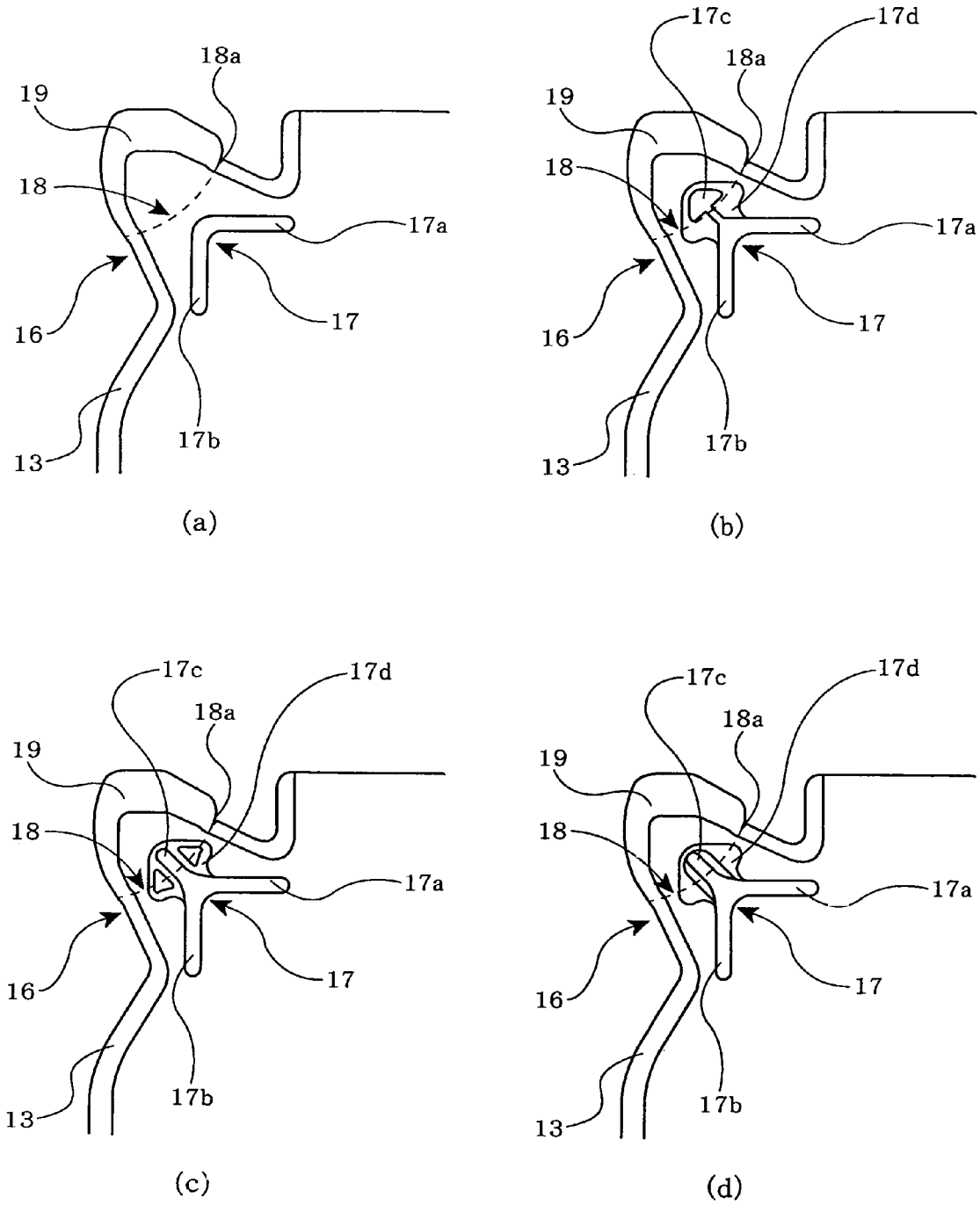
FIGS. 6(*a*) to 6(*d*) are diagrams showing modifications of a ridge line guiding part in the embodiment of the pouch for refill of contents according to the invention.

The invention is also not limited to the concrete shape of the ridge line guiding part 17. Any shape can be used as long as the ridge line 20 formed in the base material film can be guided. For example, as shown in FIG. 6(*a*), only the horizontal part 17*a* and the trailing part 17*b* may be provided and the extended part 17*c* and the adhesion preventing part 17*d* can be properly emitted. The invention is not limited to the concrete shapes of the extended part 17*c* and the adhesion preventing part 17*d*. For example, various shapes as shown in FIGS. 6(*b*) to 6(*d*) can be also employed. The horizontal part 17*a* and the trailing part 17*b* are not limited to the linear shape but, although not shown, may have a curved shape.

As described above, the pouch for refill of contents according to the present invention is suitably used as a container for refill such as detergent, bleach, softening agent, laundry starch, shampoo, conditioner, or the like.

What is claimed is:

1. A pouch for refill of contents, comprising:

a bag made of a flexible base material film and having a nozzle for discharging the contents at one edge of the bag, and a ridge line guiding part provided near the nozzle, the ridge line guiding part forming an embossment and comprising a horizontal part and a trailing part directly intersecting with each other at an end area of a center line passing through the nozzle and extending in directions away from the nozzle so that a ridge line formed in a surface of the base material film when the base material film is pressed from the inside by the contents filled in the bag extends in a direction along the center line of the nozzle.

2. The pouch for refill of contents according to claim 1, wherein the ridge line guiding part has a three-dimensional extended part which extends from a contact point between the horizontal part and the trailing part toward a tip side of the nozzle along the center line of the nozzle.

3. The pouch for refill of contents according to claim 2, wherein the bag includes an adhesion preventing part for preventing adhesion between facing surfaces of the base material film in the nozzle around the extended part, the base material film being spaced from each other at the adhesion preventing part.

4. The pouch for refill of contents according to claim 3, wherein the bag further includes a tear-off line extending through the extended part and the adhesion preventing part.

5. The pouch for refill of contents according to claim 1, wherein the nozzle includes a nozzle base part communicating with a main part of the pouch, and the horizontal part and the trailing part extend from the nozzle to the main part around the nozzle base part without substantially extending into the main part.

6. The pouch for refill of contents according to claim 5, wherein the ridge line guiding part is formed symmetrically on two sides of the bag.

7. The pouch for refill of contents according to claim 1, wherein the ridge line guiding part is an embossed part formed at the flexible base material film, and extends horizontally and downwardly from the nozzle.

* * * * *